US012310537B2

(12) United States Patent
Mayr et al.

(10) Patent No.: US 12,310,537 B2
(45) Date of Patent: May 27, 2025

(54) TOILET SEAT AND LID SYSTEM AND METHOD

(71) Applicants: Peter Mayr, Piesendorf (AT); Watschinger Karl, Kaprum (AT)

(72) Inventors: Peter Mayr, Piesendorf (AT); Watschinger Karl, Kaprum (AT)

( * ) Notice: Subject to any disclaimer, the term of this patent is extended or adjusted under 35 U.S.C. 154(b) by 211 days.

(21) Appl. No.: 18/186,522

(22) Filed: Mar. 20, 2023

(65) Prior Publication Data

US 2023/0320543 A1 Oct. 12, 2023

(30) Foreign Application Priority Data

Mar. 24, 2022 (AT) ..... 76/2022

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/26; A47K 13/12
USPC ..... 4/234
See application file for complete search history.

(56) References Cited

U.S. PATENT DOCUMENTS

| | | | | |
|---|---|---|---|---|
| 3,802,000 A | | 4/1974 | Waldon | |
| 4,639,147 A | * | 1/1987 | Schwarz | A47K 13/12 4/240 |
| 4,729,134 A | * | 3/1988 | Hillebrand | A47K 13/12 4/240 |
| 5,901,383 A | | 5/1999 | Yanagawa et al. | |
| 10,610,067 B2 | | 4/2020 | Watschinger et al. | |
| 2018/0020888 A1 | * | 1/2018 | Watschinger | A47K 13/12 4/236 |
| 2019/0181943 A1 | * | 6/2019 | Liang | H04L 25/0204 |
| 2021/0022568 A1 | * | 1/2021 | Hirasawa | A47K 13/26 |

FOREIGN PATENT DOCUMENTS

| | | | |
|---|---|---|---|
| DE | 1812393 | U | 6/1960 |
| DE | 202008013712 | U1 | 3/2009 |
| EP | 225427 | B1 | 12/1990 |
| EP | 3267867 | B1 | 8/2018 |
| EP | 3517006 | A1 | 7/2019 |
| EP | 3569122 | A1 | 11/2019 |
| JP | H0548798 | U | 6/1993 |
| JP | 2010124882 | A | 6/2010 |
| JP | 2019170459 | A | 10/2019 |
| WO | 9111951 | A1 | 8/1991 |
| WO | 2016145464 | A1 | 9/2016 |

* cited by examiner

*Primary Examiner* — Huyen D Le
(74) *Attorney, Agent, or Firm* — David Guerra

(57) ABSTRACT

A toilet seat, system and method including hinge sleeves and a clamping element. The toilet seat being configured to be pushed or pushed open from a same side with the hinge sleeves on a hinge. The toilet seat in a first position is configured to be pushed onto the hinge that is coaxially with the toilet seat and rotatable to a rotation axis of the hinge. The clamping element can feature two bearing tabs protruding therefrom that are configured to secure the toilet seat against axial displacement. At least one of the bearing tabs can include a changeable stop by rotary movement of the clamping element around the axis of rotation.

14 Claims, 5 Drawing Sheets

TOILET SEAT AND LID SYSTEM AND METHOD

CROSS-REFERENCE TO RELATED APPLICATION

The present application claims priority under 35 U.S.C. 119(a) to Austrian (AT) patent application number A 76/2022 filed on Mar. 24, 2022, which is incorporated herein by reference in its entirety.

BACKGROUND

Technical Field

One or more embodiments of the present technology relates to a toilet seat and lid system and method for use in connection with quickly removing the lid from the seat. The present technology relates to a toilet seat, which is molded to the toilet seat on a hinge from the same side can be pushed or pushed on, wherein the toilet seat in a hinge pushed position by a coaxial motion on the hinge with the toilet seat rotatable around an axis of rotation of the hinge clamping element with two protruding bearing tabs is secured against axial displacement. The present technology can further relate to a toilet with a toilet bowl and with such a toilet seat.

Background Description

The currently most common attachment of (not genuine) toilet seats comprising a toilet seat to a toilet bowl is carried out by screwing in opposite directions pointing bearing pins of a hinge, whose threaded pins are led through holes of the toilet bowl and attached to its underside. The toilet seat is preferably assigned both together with the toilet seat and alone around the same hinge axis (axis of rotation of the hinge) with a swinging up toilet lid. The bearing pins reach into hinge sleeves provided for this purpose, preferably holes or eyelets of the toilet seat and the toilet lid, which are therefore neither separable during assembly nor during disassembly.

This non-freely accessible connection of toilet seat and toilet lid with the toilet bowl hinders thorough cleaning of the hinge area, and the bearing pins intervene in cavities, which also form inaccessible areas.

Especially in hospitals, nursing homes or the like, effective cleaning up to sterilization is extremely important to contain the spread of pathogenic bacteria, infectious viruses, fungi and parasites. For this, a simple disassembly of the toilet seats is an advantage.

A removable without technical aids (genus) toilet seat with a toilet seat is known from EP 3,267,867 B1. There, the toilet seat with molded hinge sleeves is pushed from the same side onto spaced coaxial bearing pins and secured against axial displacement by a clamping element encompassing at least one hinge side. In further explanations it is described that the stop is provided on a coaxial rotatable toilet lid around the hinge axis with the toilet seat. The securing of the toilet lid is carried out in such a way that a hinge element is formed as a sleeve and is pushed onto a bearing pin. On the second page, several latches are shown. On the one hand, a bridge-like protrusion of the toilet lid was described, which intervenes in a one-sided opening of the hinge sleeve of the toilet seat. This is possible at a certain angle. Another illustration shows a curved track, which may also have a bottleneck and thus secure the toilet lid. Both variants have weaknesses in that the rotational movement of the toilet lid is blocked if not completely threaded through an opening and leads to the breakage of the web-like protrusion if improperly operated. The threading over a curved track with a bottleneck seems to be more stable here, however there is a mechanical stress due to a possible bottleneck, which loses strength through frequent actuation and, in the worst case, leads to failure. If there is no bottleneck, there is again no safeguard against accidental loosening of the toilet lid.

SUMMARY

In view of the foregoing disadvantages inherent in the known types of removable toilet lids, the present technology provides a novel toilet seat and lid system and method, and overcomes one or more of the mentioned disadvantages and drawbacks of these known systems, devices or methods. As such, the general purpose of the present technology, which will be described subsequently in greater detail, is to provide a new and novel toilet seat and lid system and method and method which has all the advantages of the known systems and/or methods mentioned heretofore and many novel features that result in a toilet seat and lid system and method which is not anticipated, rendered obvious, suggested, or even implied by the known systems and/or methods, either alone or in any combination thereof.

According to one aspect, the present technology can include a toilet seat including hinge sleeves and a clamping element. The hinge sleeves can be configured to be pushed or pushed open from a same side with the hinge sleeves on a hinge. The toilet seat in a first position can be configured to be pushed onto the hinge that is coaxially with the toilet seat and rotatable to a rotation axis of the hinge. The clamping element can feature two bearing tabs protruding therefrom. The two protruding bearing tabs can be configured to secure the toilet seat against axial displacement. At least one of the bearing tabs of the clamping element can represent a changeable stop by rotary movement of the clamping element around the axis of rotation.

According to another aspect, the present technology can include a toilet seat system including a toilet seat and a toilet lid. The toilet seat can include hinge sleeves, and can be configured to be pushed or pushed open from a same side with the hinge sleeves on a hinge. The toilet seat in a first position can be configured to be pushed onto the hinge that is coaxially with the toilet seat and rotatable to a rotation axis of the hinge. The toilet lid can include a clamping element featuring two bearing tabs protruding therefrom. The two protruding bearing tabs can be configured to secure the toilet seat against axial displacement. At least one of the bearing tabs of the clamping element can represent a changeable stop by rotary movement of the clamping element around the axis of rotation.

According to still another aspect, the present technology can include a toilet with a toilet bowl and including a toilet seat system. The toilet system can include a toilet seat and a toilet lid. The toilet seat can include hinge sleeves, and can be configured to be pushed or pushed open from a same side with the hinge sleeves on a hinge. The toilet seat in a first position can be configured to be pushed onto the hinge that is coaxially with the toilet seat and rotatable to a rotation axis of the hinge. The toilet lid can include a clamping element featuring two bearing tabs protruding therefrom. The two protruding bearing tabs can be configured to secure the toilet seat against axial displacement. At least one of the bearing tabs of the clamping element can represent a changeable stop by rotary movement of the clamping element around the axis of rotation. The hinge can be arranged on the toilet bowl.

According to yet another aspect, the present technology can include a toilet seat configured to avoid the disadvantages of known toilet seats and to provide an improved toilet seat compared to the prior art. Furthermore, a toilet with a toilet bowl and with such an improved toilet seat can be specified.

According to still yet another aspect, the present technology can include a method of using a toilet seat system including a toilet seat and a toilet lid. The method can include pushing a toilet lid from a same side of hinge sleeves on a hinge of a toilet seat that is coaxially with the toilet seat and rotatable to a rotation axis of the hinge while two bearing tabs extending from the toiled lid are engaged with the hinge. Rotating the toilet lid about the rotation axis so that one of the bearing tabs is free to be disengaged from the hinge. Removing a changeable stop of a second of the bearing tabs is removable from the hinge.

According to still yet another aspect, the present technology can include a method of using a toilet seat system including a toilet seat and a toilet lid with a clamping element mounted on a hinge coaxially with the toilet seat and rotatable around an axis of rotation of the hinge, and can secure the toilet seat against axial displacement. The method can include rotating the clamping element about the axis of rotation so that a stop of a first bearing tab of the clamping element is moved about a bearing pin of the hinge. Changing an angle of the stop in relation to the bearing pin to allow axial displacement of the clamping element in such a way that the bearing pin can intervene in the first bearing tab attached to the bearing pin on the clamping element, resulting in an axial displacement of the clamping element along the axis of rotation of the hinge. Axially shifting the clamping element thereby allowing the clamping element to be removed from the hinge, whereupon the toilet seat can also be pushed axially away from the hinge.

According to still another aspect, the present technology can include a toilet seating system for a toilet comprising a toilet seat, a clamping element that can be in the form of a toilet lid, and a hinge. To mount the toilet seating system on a toilet, the hinge can be placed on a toilet bowl of the toilet and then the toilet seat and clamping element are placed on the hinge. In mounting position (from hinge to toilet bowl and from toilet seat and clamping element on the hinge), the toilet seat with the hinge sleeves can be pushed onto the hinge from the same side and through the hinge coaxial with the toilet seat around the axis of rotation of the hinge rotatable bracket element secured against axial displacement.

In some or all embodiments, the hinge can include a first bearing pin coaxial along the axis of rotation of the hinge, a second bearing pin that is spaced from the first bearing pin, a first hinge pin protruding from the first bearing pin in a first direction along the rotation axis of the hinge; and a second hinge pin protruding from the second bearing pin in the first direction along the rotation axis of the hinge. The hinge sleeves can include a first hinge sleeve and a second hinge sleeve. The first hinge sleeve can be slidable or pushed on the first hinge pin. The second hinge sleeve can be slidable or pushed on the second hinge pin.

In some or all embodiments, the changeable stop can be on the first bearing pin when the clamping element is on a hinge arranged position on the hinge.

In some or all embodiments, the first bearing pin can include a third hinge pin protruding therefrom in a second direction along the rotation axis of the hinge that is opposite to the first direction along.

In some or all embodiments, the second hinge pin can protrude in the first direction beyond the second hinge sleeve when a position of the toilet seat is pushed onto the hinge.

In some or all embodiments, the clamping element can be associated with a toilet lid rotatable around the rotation axis of the hinge.

In some or all embodiments, the changeable stop can be formed in at least one of the two bearing tabs protruding from the toilet lid.

In some or all embodiments, the two bearing tabs of the toilet lid comprises a first bearing tab and a second bearing tab. The changeable stop can be formed on the first bearing tab.

In some or all embodiments, the first bearing tab can have a top surface facing the second bearing tab. The stop surface can include an indentation defined therein. The changeable stop can include the stop surface and the indentation.

In some or all embodiments, the first bearing tab can protrude from the toilet lid in an extension direction substantially perpendicular to an extension plane of the toilet lid that protrudes from the toilet lid. The indentation can have a longitudinal length in a longitudinal extension direction, where imaginary lines along the extension direction and the longitudinal extension direction include an angle.

In some or all embodiments, the indentation can have a configuration corresponding to an external form of the first bearing pin.

In some or all embodiments, the indentation can include a first recess.

In some or all embodiments, the second bearing tab can include a clamping surface facing the first bearing tab, and a second recess extending in a recess longitudinal extension. The clamping surface starting from the second recess can have a radial opening. The radial opening can extend over an opening portion of an outer contour of the second bearing tab. The radial opening starting from the second recess can have a radial surface running substantially transversely to the recess longitudinal extension.

In some or all embodiments, in the hinge arranged position of the toilet lid, the third hinge pin can protrude into the first recess of the first bearing tab. The changeable stop can be attached to the first bearing pin. Depending on a rotation position of the toilet lid about the axis of rotation, the stop surface or the indentation on the first bearing pin can be present. The second hinge pin can protrude beyond the second hinge sleeve and into the second recess.

In some or all embodiments, in a rotating position of the toilet lid, the stop surface can be on the first bearing pin, one end of the second hinge pin can be a direction of the recess longitudinal extension and can protrude beyond the radial surface into the second recess. The rotation position of the toilet lid, in which the indentation rests on the first bearing pin, an end of the second hinge pin can be the direction of the recess longitudinal extension is located in front of the radial surface.

In some or all embodiments, the clamping element can be mounted on the hinge coaxially with the toilet seat rotatable around the axis of rotation of the hinge, and can secure the toilet seat against axial displacement. At least one of the bearing tabs of the clamping element can include a stop which is attached to a bearing pin of the hinge and which represents a stop that can be changed by rotating the clamping element about the axis of rotation. The stop can change over the angle of rotation and allows an axial displacement of the clamping element in such a way that the bearing pin can intervene in the bearing tab attached to the bearing pin on the clamping element, resulting in an axial displacement of the clamping element along the axis of rotation of the hinge. If the clamping element is axially shifted, the clamping element can be removed from the hinge, whereupon the toilet seat can also be pushed axially away from the hinge.

In some or all embodiments, the changeable stop can serve to arrange the clamping element, which may be designed as a toilet lid, at a certain swivel position or rotation position of the clamping element around the axis of rotation of the hinge in a particularly simple manner on the hinge and to be able to remove it from the hinge.

In some or all embodiments, it may be provided that the hinge in mounting position comprises a first bearing pin and a coaxial along the axis of rotation of the hinge from the first bearing pin spaced second bearing pin, wherein at the first bearing pin a first direction along the axis of rotation protruding first hinge pin is arranged, wherein at the second bearing pin a protruding in the first direction along the axis of rotation. The hinge pin is arranged, wherein the toilet seat has a first hinge sleeve and a second hinge sleeve, wherein the first hinge sleeve is slidable or pushed on the first hinge pin, wherein the second hinge sleeve on the second hinge pin can be pushed or pushed open, wherein preferably in the position of the toilet seat pushed onto the hinge and the position of the clamping element arranged on the hinge, the changeable stop is attached to the first bearing pin.

In other words, the hinge can comprise two coaxial bearing pins which can be arranged or arranged on a toilet bowl. To attach the toilet seat, the toilet seat can be pushed onto the hinge from the same side (in one direction opposite to the first direction) with the hinge shaped onto the toilet seat by pushing it by means of the hinge sleeves on the two hinge pins protruding in the first direction from the bearing pins opposite the first direction until the hinge sleeves of the toilet seat are attached to the bearing pins. Without the intended clamping element, the toilet seat pushed onto the hinge pins could be removed from the hinge in the first direction.

In the position pushed onto the hinge, the toilet seat can be rotated around the axis of rotation. When the clamping element is positioned on the hinge, the clamping element secures the toilet seat against axial displacement. The clamping element can also be rotated around the axis of rotation and includes a bearing tab that represents the changeable stop that lies on the first bearing pin. The changeable stop attached to the first bearing pin changes over the angle of rotation and allows an axial displacement of the clamping element in such a way that the first bearing pin can intervene in the bearing tab on the clamping element adjacent to the first bearing pin, which results in an axial displacement of the clamping element in the first direction along the axis of rotation of the hinge.

In some or all embodiments, it may be provided that at the first bearing pin a second direction running in the opposite direction along the axis of rotation protruding third hinge pin is arranged.

In some or all embodiments, the third hinge pin, one of the bearing tabs of the clamping element may be arranged by the third hinge pin engaging in a corresponding recess of the bearing tab, whereby the toilet seat is clamped to am first end of the toilet seat.

In some or all embodiments, the first hinge pin and the third hinge pin are formed on a common rod which penetrates the first bearing pin.

In some or all embodiments, the second hinge pin may preferably be formed on a rod that penetrates the second bearing pin.

In some or all embodiments, the position of the toilet seat pushed onto the hinge, the second hinge pin protrudes in the first direction over the second hinge sleeve.

On the part of the second hinge pin projecting beyond the second hinge sleeve, one of the bearing tabs of the clamping element may be arranged by the second hinge pin engaging in a corresponding recess of the bearing tab, whereby the toilet seat is clamped at a second end of the toilet seat.

In some or all embodiments, it may be provided that the clamping element is formed as a rotatable around the axis of rotation of the hinge with the toilet seat stored toilet lid.

In other words, the changeable stop is provided on a toilet lid coaxially rotatable with the toilet seat around the axis of rotation of the hinge. A clamping element in the form of the toilet lid, the two protruding bearing tabs are arranged, which secure the toilet seat against axial displacement. At least one of the bearing tabs of the toilet lid represents the stop that can be changed by the rotary movement.

In some or all embodiments, the changeable stop is formed at least one of the two bearings protruding from the toilet lid tabs.

In some or all embodiments, it may be provided that the toilet lid has a first bearing tab and a second bearing tab, wherein the changeable stop is formed on the first bearing flap.

In some or all embodiments, it may be provided that the first bearing tab has a stop surface facing the second bearing tab, wherein an indentation is formed in the stop surface, wherein the changeable stop is formed by the stop surface and the indentation formed in the stop surface.

If the hinge comprises two coaxially spaced bearing pins and in the position of the toilet seat pushed onto the hinge and the position of the toilet lid arranged on the hinge, the changeable stop formed in the first bearing tab is attached to the first bearing pin, the changeable stop adjacent to the first bearing pin changes by rotary movement of the toilet lid around the axis of rotation, since depending on the rotation position of the toilet lid, either the stop surface or the indentation lies on the first bearing pin. In the case of a transition from stop surface to indentation, an axial displacement of the toilet lid takes place, i.e. when the toilet lid is rotated, in which the indentation rests on the first bearing pin, the toilet lid is axially shifted along the axis of rotation. In other words, the changeable stop attached to the first bearing pin changes by rotating the toilet lid around the axis of rotation and allows an axial displacement of the toilet lid in such a way that the first bearing pin is inserted into the indentation formed in the first bearing tab of the toilet lid, resulting in axial displacement of the clamping element in the first direction along the axis of rotation of the hinge.

In some or all embodiments, it may be provided that the first bearing tab in an extension direction substantially perpendicular to an extension plane of the toilet lid from the toilet lid, wherein the indentation has a longitudinal extension in a longitudinal stretch direction, wherein imaginary lines along the extension direction and the longitudinal extension direction include an angle.

The angle may be chosen so that the first bearing pin can intervene at about half-open position of the toilet lid in the indentation formed in the first bearing tab of the toilet lid, wherein in the other rotation position of the toilet lid, in particular when the toilet lid is closed or open, the stop surface of the changeable stop lies on the first bearing pin. As a result, it can be achieved that when the toilet lid is closed or opened, an inseparable unit (of toilet seat arranged on the hinge and toilet lid arranged on the hinge) is formed. However, if the toilet lid is half opened, the toilet lid can be moved axially by the modified stop, whereby first the toilet lid and then also the toilet seat can be removed from the hinge.

In some or all embodiments, it may be provided that the indentation is formed corresponding to an outer shape of the first bearing pin.

As a result, the first bearing pin can be picked up with the appropriate rotation of the toilet lid essentially precisely in the indentation.

In some or all embodiments, it may be provided that a first recess is formed in the indentation.

The first recess may be formed in the form of a through hole, which intersperses the first bearing tab.

If a third hinge pin is arranged on the first bearing pin in a second direction running along the axis of rotation in an opposite direction to the first direction, this third hinge pin may engage in the first recess, whereby the toilet lid is rotatable around the third hinge pin. In the case of a rotary movement of the toilet lid around the axis of rotation of the hinge—which runs through the first recess in the mounting position of the toilet lid on the hinge—the first bearing tab thus represents the stop for the first bearing pin, which can be changed by the rotary movement of the toilet lid around the axis of rotation.

In some or all embodiments, it may be provided that the second bearing tab has a bracket surface facing the first bearing tab, wherein the second bearing tab has a second recess extending in a recess longitudinal extension starting from the clamping surface, wherein the staple surface has a radial opening starting from the second recess, wherein the radial opening is over an opening portion of an outer contour of the second bearing tab, wherein the radial opening starting from the second recess has a radial surface substantially transverse to the recess longitudinal extension. The recess longitudinal extension can be essentially perpendicular to the staple surface, and the radial surface may be substantially parallel to the staple surface.

The second recess may be formed in the form of a blind hole, which does not fully penetrate the second bearing tab. The second recess in the second bearing tab can align with the first recess in the first bearing tab, so that when the position of the toilet lid is arranged on the hinge, the first recess and the second recess run along the axis of rotation of the hinge.

In some or all embodiments, the end the second hinge pin may be taken up in the second compartment or intervene or protrude into the second recess when the toilet lid is pressed on the hinge. Through the radial opening, the second bearing tab can be placed on the end of the second hinge when the toilet lid is pressed on the hinge and removed from the second hinge when the toilet lid is removed from the hinge.

In some or all embodiments, it may be provided that at the hinge positioned position of the toilet lid, the third hinge pin protrudes into the first recess of the first bearing tab, wherein the changeable stop lies on the first bearing pin, wherein depending on the rotation position of the toilet lid around the axis of rotation, the stop surface or the indentation is located on the first bearing pin, wherein the second hinge pin protruding beyond the second hinge sleeve into the second recess.

If the stop surface rests on the first bearing pin, then the end of the second hinge pin is protruding beyond the second hinge sleeve protrudes into the second recess, so that the end of the second hinge pins partially engages the second recess or is partially included in the second recess.

In some or all embodiments, it may be provided that in a rotation position of the toilet lid, in which the stop surface is attached to the first bearing pin, one end of the second hinge pin in the direction of the recess longitudinal extension beyond the radial surface protrudes beyond the radial surface into the second recess, wherein at a rotating position of the toilet lid, in which the indentation is attached to the first bearing pin, the end of the second hinge pin in the direction of the recess longitudinal extension in front of the radial surface.

In a first rotation position of the toilet lid, in which the stop surface rests on the first bearing pin, the third hinge pin protrudes into the first recess and the second hinge pin protrudes into the second recess, with the end of the second hinge pin protruding in the direction of the recess longitudinal extension beyond the radial surface into the second recess. In such a rotating position of the toilet lid, the toilet lid is rotatable mounted on the third hinge pin and second hinge pin. The stop surface of the first bearing tab lies on the first bearing pin and the clamp surface of the second bearing tab lies at one end of the second hinge sleeve. In such a rotating position, the toilet lid cannot be removed from the hinge.

In some or all embodiments, the indentation may be formed in such a way in the first bearing tab that at least with closed and fully open toilet lid is a first rotation position. This means that when the toilet lid is closed or fully open, the first bearing pin does not interfere with the indentation, but the stop surface lies on the first bearing pin.

In a second rotation position of the toilet lid, in which the indentation rests on the first bearing pin, the first bearing pin is partially absorbed in the indentation, whereby the toilet lid is offset axially in the first direction along the axis of rotation according to the depth of the indentation starting from the stop surface. Also in this rotation position, the third hinge pin protrudes into the first recess and the second hinge pin protrudes into the second recess. However, due to the axial offset of the toilet lid in the first direction along the axis of rotation, the second bearing tab is also offset accordingly axially, so that the end of the second hinge pin in the direction of the recess longitudinal extension is now in front of the radial surface. As a result, in this rotation position of the toilet lid, the second hinge can be lifted from the second hinge pin, since the end of the second hinge pin can escape through the radial opening. After such removal of the second hinge ash from the second hinge pin, the toilet lid can be removed from the hinge by pushing off the first bearing tab from the third hinge pin in the second direction, whereupon the toilet seat is pushed off along the first direction of the first hinge pin and second hinge pin and thus also removed from the hinge can be used.

In some or all embodiments, the indentation may be formed in such a way in the first bearing tab that the second rotation position is located about half the possible opening path of the toilet lid.

Some or all embodiments of the present technology can cover a toilet with a toilet bowl and with a toilet seat according to the manner described above, wherein the hinge is arranged on the toilet bowl.

In some or all embodiments, it may be provided that the hinge comprises a first bearing pin and a coaxial along the axis of rotation des hinge from the first bearing pin separated second bearing pin, wherein the two bearing pins are arranged in a known manner on the toilet bowl by corresponding threaded pins of the bearing pins through holes of the toilet bowl and at their bottom against the toilet bowl are screwed.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

It is therefore an object of the present technology to provide a new and novel toilet seat and lid system and method that has all of the advantages of the known systems and/or methods and none of the disadvantages.

It is another object of the present technology to provide a new and novel toilet seat and lid system and method that may be easily and efficiently manufactured and marketed.

An even further object of the present technology is to provide a new and novel toilet seat and lid system and method that has a low cost of manufacture with regard to both materials and labor, and which accordingly is then susceptible of low prices of sale to the consuming public, thereby making such toilet seat and lid system and method economically available to the buying public.

Still another object of the present technology is to provide a new toilet seat and lid system and method that provides in the apparatuses and methods of the known systems and/or methods some of the advantages thereof, while simultaneously overcoming some of the disadvantages normally associated therewith.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology. Whilst multiple objects of the present technology have been identified herein, it will be understood that the claimed present technology is not limited to meeting most or all of the objects identified and that some embodiments of the present technology may meet only one such object or none at all.

BRIEF DESCRIPTION OF THE DRAWINGS

The present technology will be better understood and objects other than those set forth above will become apparent when consideration is given to the following detailed description thereof, with phantom lines (long-short-short-long lines) depicting environmental structure and forming no part of the claimed present technology. Such description makes reference to the annexed drawings wherein:

The same reference numerals refer to the same parts throughout the various figures.

DETAILED DESCRIPTION OF THE EMBODIMENTS

Figure 1:
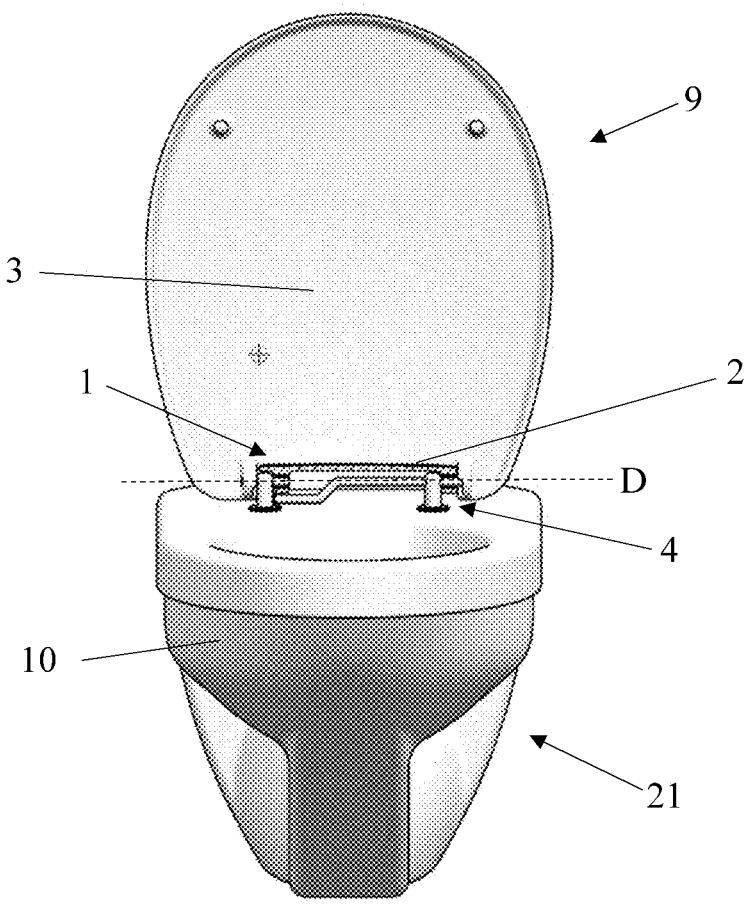
FIG. 1 is a front view of a toilet with a proposed toilet seat with the clamping element fully open in the form of a toilet lid, wherein the toilet seat is shown in cross-section.

While the above-described devices fulfill their respective, particular objectives and requirements, the aforementioned devices or systems do not describe a toilet seat and lid system and method that allows quickly removing the lid from the seat. The present technology additionally overcomes one or more of the disadvantages associated with the known systems and/or methods.

A need exists for a new and novel toilet seat and lid system and method that can be used for quickly removing the lid from the seat. In this regard, the present technology substantially fulfills this need. In this respect, the toilet seat and lid system and method according to the present technology substantially departs from the conventional concepts and designs of the known systems and/or methods, and in doing so provides an apparatus primarily developed for the purpose of quickly removing the lid from the seat.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

FIGS. 1 to 8 shows a toilet 21 comprising a toilet bowl 10 with an arranged thereon, a toilet seat 2 and a clamping element 9 in the form of a toilet lid 3 comprising toilet seat 1. The toilet seat 1 is attached by means of hinge 4 to the toilet bowl 10 in a known manner. The hinge 4 comprises two coaxially spaced along the axis of rotation D of the hinge 4 bearing pins 11, 12, each comprising a threaded pin or the like not visible here, which extends through openings in the toilet bowl 10 and is attached to the underside by an easily detachable, not shown locking nut. The toilet seat 2 and the toilet lid 3 can be swiveled both independently of each other and together around the hinge axis specified by the hinge 4 in the form of the axis of rotation D.

Figure 2:
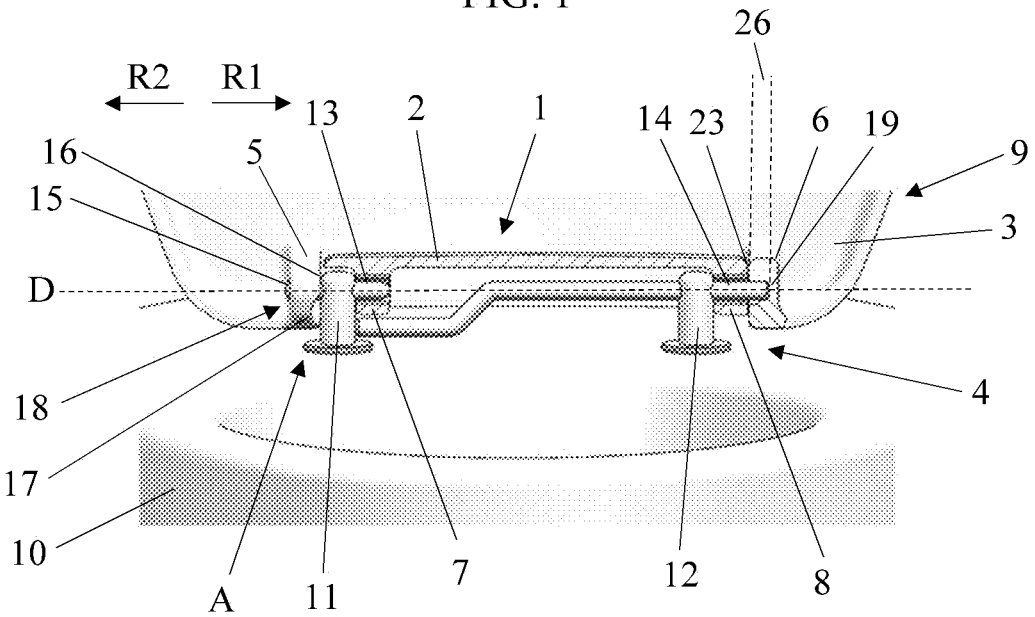
FIG. 2 is an enlarged representation of the hinge area of the toilet seat according to FIG. 1.

FIGS. 1 and 2 show the toilet seat 1 in a position arranged on the hinge 4 in a rotating position of the toilet lid 3, which corresponds to an essentially fully opened toilet lid 3. In FIG. 1, the toilet seat 2 is shown cut in the region of the hinge 4 in order to better recognize and explain details of the proposed toilet seat 1, and FIG. 2 shows an enlarged representation of the hinge area of the toilet seat 1 according to FIG. 1, wherein here additionally also the second bearing tab 6 of the clamping element 9 in the form of the toilet lid 3 is shown cut in the area of the hinge 4.

Figure 3:
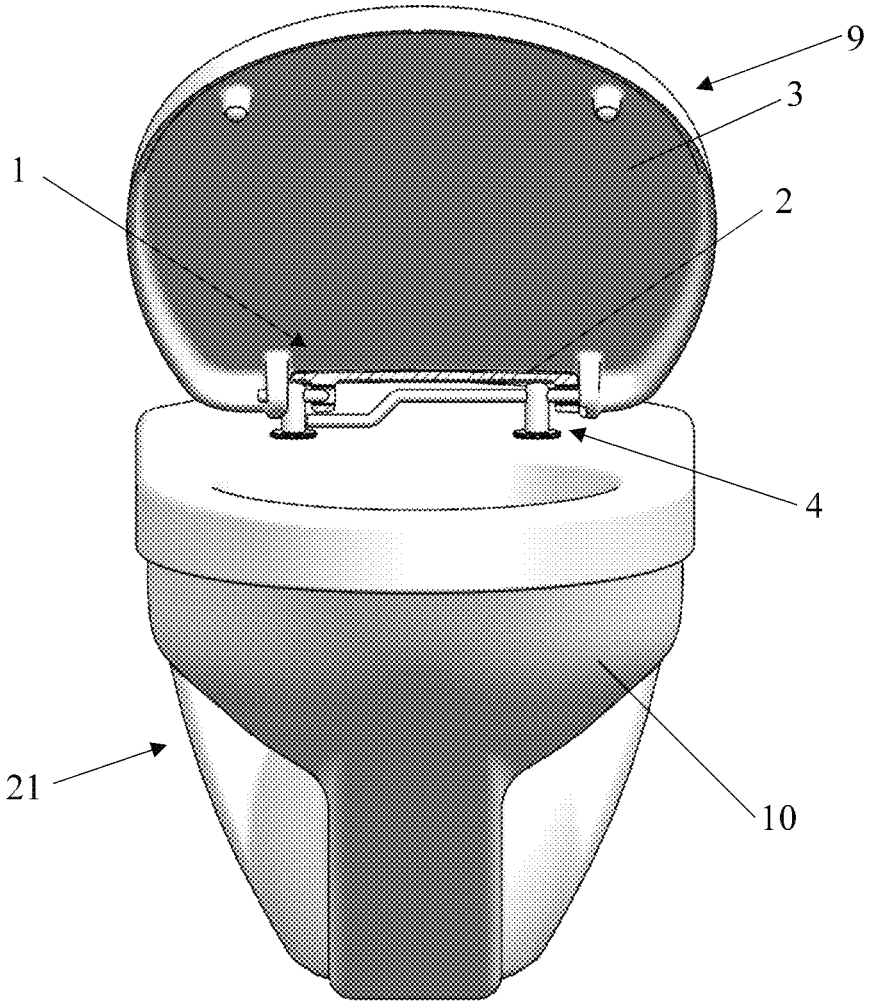
FIG. 3 is a front plane view of the toilet of FIG. 1 with the toilet lid in a half-open position.
Figure 4:
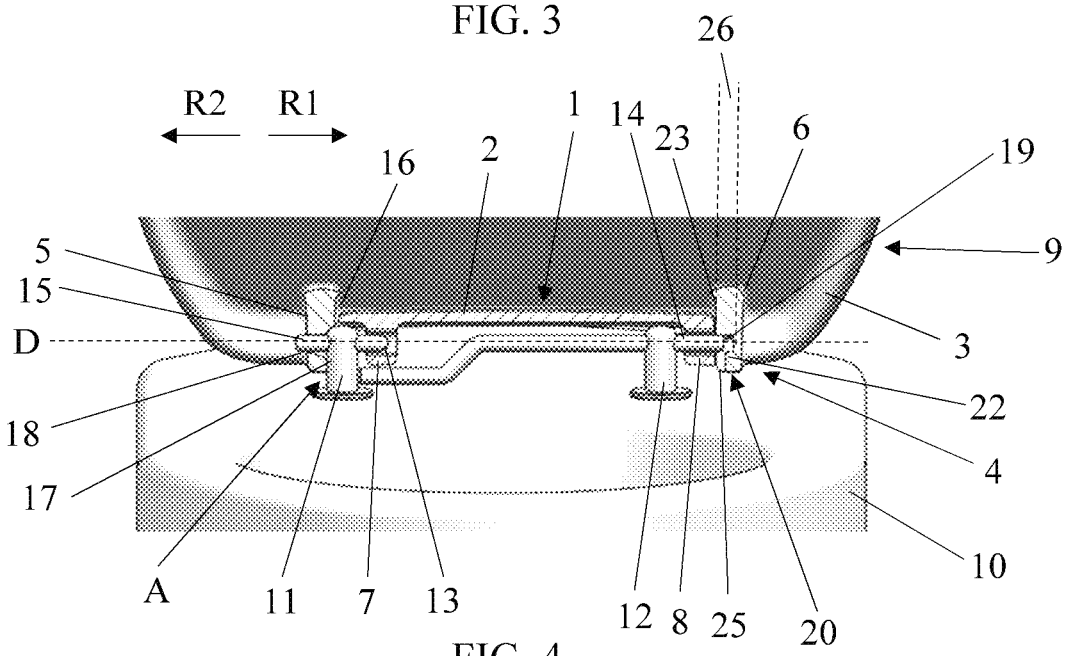
FIG. 4 is an enlarged representation of the hinge area of the toilet seat according to FIG. 3.

FIGS. 3 and 4 show the toilet seat 1 in a rotating position of the toilet lid 3, which corresponds to an essentially half-opened toilet lid 3. FIG. 3 shows the toilet seat 2 cut in the region of the hinge 4 in order to be able to better recognize and explain details of the proposed toilet seat 1, and FIG. 4 shows an enlarged representation of the hinge area of the toilet seat 1 according to FIG. 3, wherein here additionally also the first bearing tab 5 and the second bearing tab 6 of the clamping element 9 in the form of the toilet lids 3 in the area of the hinge 4 are shown cut.

Figure 5:
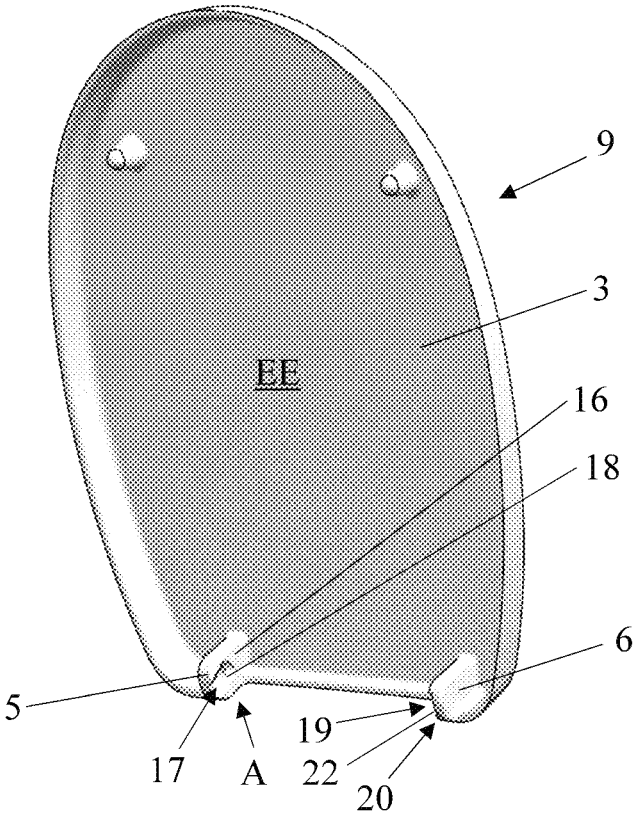
FIG. 5 is an oblique or perspective view of the toilet lid according to FIG. 1.
Figure 6:
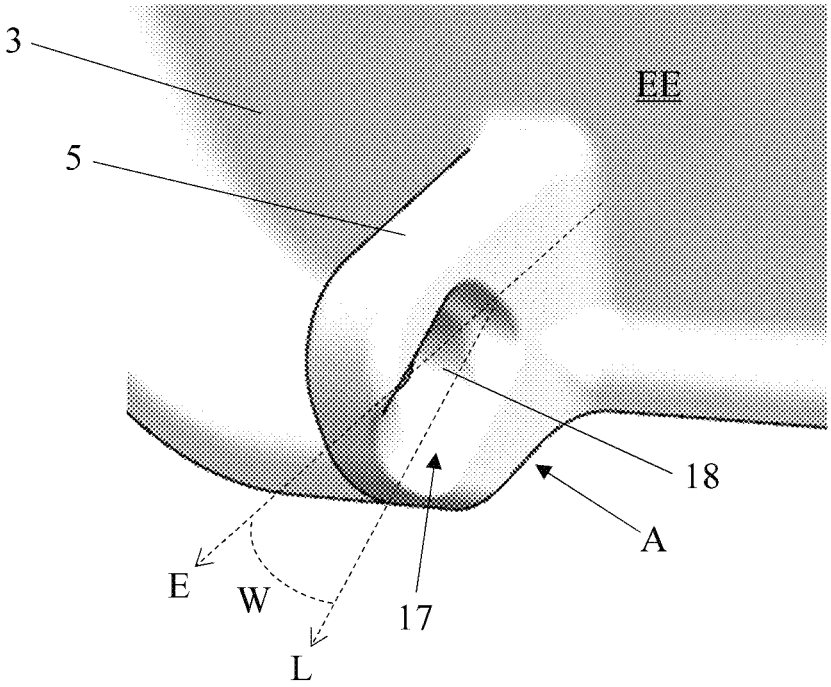
FIG. 6 is an enlarged representation of the first bearing tab of the toilet lid according to FIG. 5.
Figure 7:
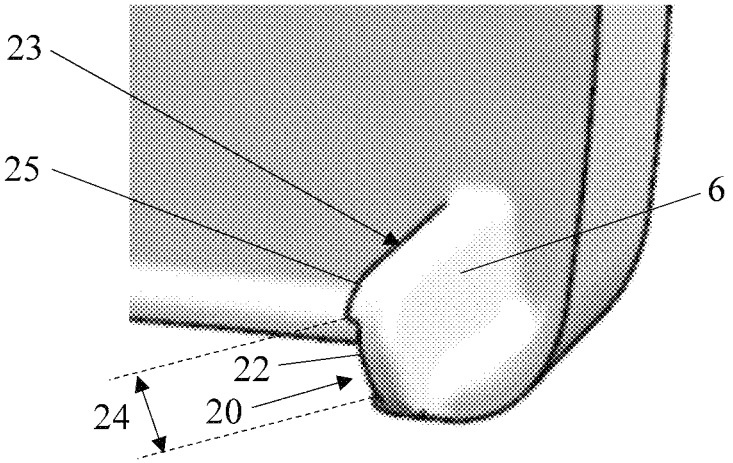
FIG. 7 an enlarged representation of the second bearing tab of the toilet lid according to FIG. 5.

FIG. 5 shows an oblique view of the toilet lid 3 according to FIGS. 1 to 4, FIG. 6 shows an enlarged representation of the first bearing tab 5 of the toilet lid 3 according to FIG. 5 and FIG. FIG. 7 shows an enlarged representation of the second bearing tab 6 of the toilet lid 3 according to FIG. 5.

In FIGS. 1 and 2 it can be seen that the toilet seat 2 with hinge sleeves 7, 8 molded to the toilet seat 2 is pushed onto the hinge 4 from the same side. The toilet seat 2 is secured against axial displacement by the clamping element 9 with two protruding bearing tabs 5, 6 rotatable on the hinge 4 coaxially with the toilet seat 2 around the axis of rotation D of the hinge 4. The bearing tabs 5, 6 of the clamping element 9 (in the example shown the first bearing tab 5) represents a changeable stop A by rotating the clamping element 9 around the axis of rotation D. The clamping element 9 is formed in the example shown as a about the axis of rotation D of the hinge 4 coaxially with the toilet seat 2 rotatable stored r toilet lid 3.

As will be explained below, the changeable stop A serves to arrange the clamping element 9 in the form of the toilet lid 3 at a certain swivel position or rotation position of the toilet lid 3 around the axis of rotation D in a particularly simple manner on the hinge 4 and to be able to remove it from the hinge 4.

The hinge 4 comprises a first bearing pin 11 and a second bearing pin 12 spaced coaxially along the axis of rotation D of the hinge 4 from the first bearing pin 11. The first bearing pin 11, a protruding in a first direction R1 along the axis of rotation D first hinge pin 13 is arranged and at the second bearing pin 12 a protruding in the first direction R1 along the axis of rotation D is arranged second hinge pin 14.

The toilet seat 2 has a first hinge sleeve 7 and a second hinge sleeve 8, wherein the first hinge sleeve 7 is pushed onto the first hinge pin 13 and the second hinge sleeve 8 is pushed onto the second hinge pin 14. The second hinge pin 14 protrudes in the first direction R1 beyond the second hinge sleeve 8. In this position of the toilet seat 2 pushed onto the hinge 4, the first hinge sleeve 7 lies on the right outside of the first bearing pin 11 on the first bearing pin 11 and the second hinge sleeve 8 lies on the right outside of the second bearing pin 12 on the second bearing pin 12. In other words, the toilet seat 2 was in a second direction R2 running opposite to the first direction R1 by means of first hinge sleeve 7 and second hinge sleeve 8 on the first hinge pin 13 and the second hinge pin 14 pushed until the hinge sleeves 7, 8 struck the bearing pins 11, 12 and thus no further pushing in the second direction R2 was possible.

At the first bearing pin 11, a second direction R2 running in the opposite direction to the first direction R1 along the axis of rotation D protruding third hinge pin 15 is also arranged.

In the example shown, the first hinge pin 13 and the third hinge pin 15 are formed on a common rod which penetrates the first bearing pin 11, and the second hinge pin 14 is formed on a rod which penetrates the second bearing pin 12 and runs to the first bearing pin 11, wherein this rod has a crank so that one end of this rod is located at the first bearing pin 11 below the first hinge sleeve 7.

The toilet lid 3 clasps the toilet seat 2 pushed on the hinge 4 with the bearing tabs 5, 6 of the brackets or clamping element 9 protruding from the toilet lid 3 and thus secures the toilet seat 2 against axial displacement along the first direction R1. The left in the illustration, first bearing tab 5 lies on the left outside of the first bearing pin 11 on the first bearing pin 11 in this view and the right, second bearing tab 6 lies at the right end of the toilet seat 2 on the toilet seat 2. The second hinge sleeve 8 of the toilet seat 2 is thus located between the second bearing pin 12 and the second bearing tab 6 of the toilet lid 3, so that the toilet seat cannot be pushed off the hinge in the first direction R1 and is thus secured against axial displacement along the first direction R1.

The changeable stop A is formed on the first bearing tab 5 of the toilet lid 3 and lies on the left side of the first bearing pin 11 on the first bearing pin 11. The first bearing tab 5 has a stop surface 16 facing the second bearing tab 6. In the stop surface 16, an indentation 17 is formed. The changeable stop A is formed by the stop surface 16 and the indentation 17 formed in the stop surface 16.

As can be seen in particular in the detail view of the first bearing tab 5 in FIG. 6, the first bearing tab 5 in an extension direction E is essentially perpendicular to an extension plane EE of the toilet lid 3 from the toilet lid 3, wherein the indentation 17 is a longitudinal extension in a longitudinal extension direction L. Imaginary lines along the extension direction E and the longitudinal stretch or length direction L include an angle W. In addition, in the example shown, the indentation 17 is formed corresponding to an outer shape of the first bearing pin 11 and allows the axial displacement of the toilet lid 3 in the first direction R1 at a defined angular position or rotation position of the toilet lid 3 around the axis of rotation D. This leads to the fact that in the defined by the arrangement of the indentation 17 rotation position of the toilet lid 3 around the axis of rotation D, the first bearing pin 11 can be partially taken up by the indentation 17, whereby the toilet lid 3 is shifted axially in the first direction R1 and can be removed from the hinge (see FIGS. 3, 4 and 8).

In the indentation 17, a first recess 18 is formed, which in the present example is formed in the form of a through hole which intersperses the first bearing tab 5. The first bearing tab 5 was pushed by means of the first recess 18 on the third hinge pin 15 until the changeable stop A at the first bearing pin 11 came to the system.

As can be seen in particular in the detailed view of the second bearing tab 6 in FIG. 7, the second bearing tab 6 has a bracket or clamping surface 23 facing the first bearing tab 5. In the rotation position of the toilet lid 3 around the axis of rotation D shown in FIGS. 1 and 2, the second bearing tab 6 with the clamping surface 23 is attached to the second hinge sleeve 8.

The second bearing tab 6 has starting from the clamping surface 23 a second recess 19 extending in a recess longitudinal extension 26 (see FIG. 2). The clamping surface 23 has a radial opening 20 starting from the second recess 19, wherein the radial opening 20 extends over an opening section 24 of an outer contour 25 of the second bearing tab 6, wherein the radial opening 20 starting from the second recess 19 has a radial surface 22 running substantially transversely to the recess longitudinal extension 26 (see FIGS. 4 and 7). The recess longitudinal extension 26 runs substantially perpendicular to the clamping surface 23 in the first direction R1 along the axis of rotation D and the radial surface 22 runs substantially parallel to the clamping surface 23.

The second recess 19 is formed in the present example in the form of a blind hole, which does not fully penetrate the second bearing tab 6. The second bearing tab 6 was arranged by means of the radial opening 20 and the second recess 19 on the second hinge pin 14, wherein the clamping surface 23 lies on the second hinge sleeve 8 or is slightly spaced to the second hinge sleeve 8.

When the position of the toilet lid 3 is arranged on the hinge 4, the third hinge pin 15 protrudes into the first recess 18 of the first bearing tab 5 and the second hinge pin 14 protruding beyond the second hinge sleeve 8 protrudes into the second recess 19 of the second bearing tab 6. At the first bearing pin 11, wherein depending on the rotation position of the toilet lid 3 around the axis of rotation D, the stop surface 16 or the indentation 17 is on the first bearing pin 11.

In the FIGS. 1 and 2 shown rotation position of the toilet lid 3 around the axis of rotation D, the stop surface 16 of the changeable stop A is at the first bearing pin 11. In such a rotation position of the toilet lid 3 around the axis of rotation D, wherein the stop surface 16 of the changeable stop A is attached to the first bearing pin 11, one end of the second hinge pin 14 protrudes in the direction of the recess longitudinal extension 26 beyond the radial surface 22 into the second recess 19. The indentation 17 of the changeable stop A is not in action with the first bearing pin 11 due to the opening angle of the toilet lid 3. Thus, the second bearing tab 6 is by means of the second recess 19 in engagement with the second hinge pin 14.

In the FIGS. 3 and 4 shown rotation position of the toilet lid 3 about the axis of rotation D is the toilet lid 3 in half open state. In this rotation position, the indentation 17 of the changeable stop A is attached to the first bearing pin 11. In such a rotation position of the toilet lid 3 around the axis of rotation D, wherein the indentation 17 of the changeable stop A is attached to the first bearing pin 11, the end of the second hinge pin 14 in the direction of the recess longitudinal extension 26 is located in front of the radial surface 22. This is due to the fact that the first bearing pin 11 is partially taken up in the indentation 17, whereby the toilet lid 3 is offset axially according to the depth of the indentation 17 starting from the stop surface 16 axially in the first direction R1 along the axis of rotation D, whereby also the second bearing tab 6 is offset accordingly axially in the first direction R1 along the axis of rotation D, so that the toilet lid 3 was pushed off in the first direction R1 so far from the second hinge pin 14 that the end of the second hinge pin 14 is located in the direction of the recess longitudinal extension 26 in front of the radial surface 22. As a result, the hinge pin 14 can be guided through the radial opening 20, so that it is possible, in other words, to remove the toilet lid 3 in the region of the second bearing tab 6 from the hinge by lifting the toilet lid 3 upwards on this side.

FIGS. 3 and 4 show the toilet lid 3 in a half-open state and slightly axially shifted. The axial displacement is possible because the indentation 17 at the first bearing tab 5 is in engagement with the first bearing pin 11. This displacement now allows the second hinge pin 14 of hinge 4, which was previously engaged in the second recess 19 of the second bearing tab 6 of the toilet lid, is now free. Due to the fact that by the axial displacement of the second bearing tab 6, the clamping surface 23, which limits the axial displacement of the toilet seat 2, is axially shifted, the toilet seat 2 can also participate in this axial displacement in order not to limit the path for the toilet lid 3 itself.

Thus, the toilet lid 3, as shown in FIGS. 3 and 4, is half-opened, the toilet lid 3 can be axially displaced by the modified stop A, whereby the second bearing tab 6 of the toilet lid 3 releases the second hinge pin 14.

Figure 8:
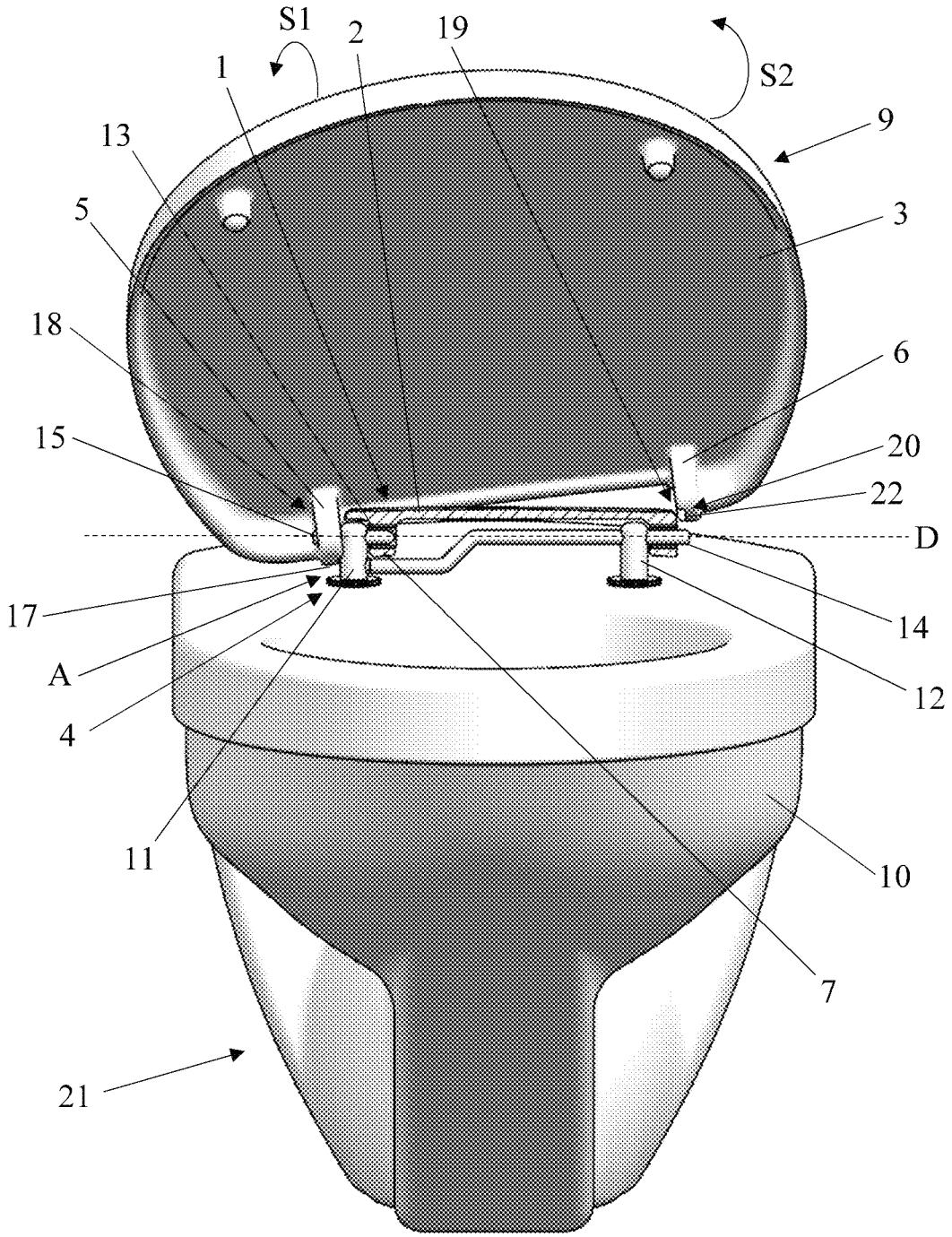
FIG. 8 is a front view of the toilet according to FIG. 3 with the toilet lid half-opened and axially shifted and tilted for dismantling the toilet lid.

FIG. 8 shows the dismantling of the toilet lid 3 at a defined opening angle of the toilet lid 3 or at a defined rotation position of the toilet lid 3 around the axis of rotation D of the hinge 4, by an axial displacement made possible by the indentation 17 and thus release of the engagement of the second hinge pin 14 in the second bearing tab 6, by simple tilting and subsequent axial displacement of the bearing tab 5 from the third hinge pin 15 of the hinges 4.

Specifically, FIG. 8 shows the toilet 21 according to FIG. 3 while half open and axially shifted and tilted for dismantling of the toilet lid 3. The toilet seat 2 is cut away in the area of the hinge 4 to better recognize the details. Starting from the open position of the toilet lid 3 shown in FIGS. 1 and 2—wherein the stop surface 16 of the changeable stop A lies on the first bearing pin 11, the third hinge pin 15 protrudes into the first recess 18 and the second hinge pin 14 protrudes into the second recess 19, wherein the end of the second hinge pin 14 in the direction of the recess longitudinal extension 26 over the radial surface 22 protrudes into the second recess 19—was pivoted in a first step S1 of the toilet lid 3 so far in the direction of the closing position around the axis of rotation D until the indentation 17 of the changeable stop A at the first bearing pin 11 came to the plant. In the present example, this is the case with about half-open position of the toilet lid 3 (see FIGS. 3 and 4).

In this rotation position of the toilet lid 3, wherein the indentation 17 is attached to the first bearing pin 11, the first bearing pin 11 is partially taken up in the indentation 17. It can be appreciated that the indentation 17 on the first bearing tab 5 is in intervention with the first bearing pin 11, whereby the toilet lid FIG. 3 is offset axially in the first direction R1 along the axis of rotation D according to the depth of the indentation 17 starting from the stop surface 16. Then the axial offset of the toilet lid 3 in the first direction R1 along the axis of rotation D, the second bearing tab 6 is also offset accordingly axially, so that now the end of the second hinge pin 14 in the direction of the recess longitudinal extension 26 in front of the radial surface 22 is located. As a result, in this rotating position of the toilet lid, the second bearing tab 6 can be lifted from the second hinge pin 14 since the end of the second hinge pin 14 can exit through the radial opening 20. While the first bearing tab 5 of the toilet lid 3 in axial displacement remains steadily in engagement with the third hinge pin 15 of the first bearing pin 11, the axial displacement allows a free passage of the second bearing tab 6 of the toilet lid 3. The free passage of the second bearing tab 6 now allows a tilting movement of the toilet lid 3. To dismantle the toilet lid 3, therefore, in the second step S2, the toilet lid 3 in the area of the second bearing tab 6 is swiveled upwards and thus detached from the second bearing pin 12.

After such a removal of the second bearing tab 6 from the second hinge pin 14 can be removed by pushing off the first bearing tab 5 from the third hinge pin 15 in the second direction R2, the toilet lid 3 from the hinge 4, whereupon the toilet seat 2 along the first direction R1 from the first hinge pin 13 and second hinge pin 14 and thus can also be removed from the hinge 4.

For the installation of the toilet seat 1 on the hinge 4 is proceeded accordingly reversed. In this case, the toilet seat 2 is first pushed along the second direction R2 on the hinge 4 by pushing first hinge sleeve 7 and second hinge sleeve 8 onto the first hinge pin 13 and the second hinge pin 14 until the hinge sleeves 7, 8 on the bearing pins 11, 12 come to engagement. Then the first bearing tab 5 is pushed onto the third hinge pin 15 by means of the first recess 18 and the toilet lid 3 is swiveled into a half-open position, so that the indentation 17 on the first bearing tab 5 is in engagement with the first bearing pin 11. In this rotation position of the toilet lid 3, the opening section 24 of the radial opening 20 faces the second hinge pin 14, so that the second bearing tab 6 can be placed on the second hinge pin 14 until the second hinge pin 14 is attached to an inner wall of the second recess 19 (the second hinge pin 14 could be inserted through the radial opening 20 into the recess 19), wherein the end of the second hinge pin 14 in the direction of the recess longitudinal extension 26 is located in front of the radial surface 22.

As soon as the rotation position of the toilet lid 3 is changed, so that the changeable stop A is transferred to the stop surface 16 and thus the stop surface 16 lies on the first bearing pin 11 and thereby the toilet lid 3 was axially offset in the second direction R2, the end of the second hinge pin 14 protrudes in the direction of the recess longitudinal extension 26 beyond the radial surface 22 into the second recess 19 and the toilet lid 3 can no longer be removed from the hinge 4 in this rotation position.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

LIST OF REFERENCE CHARACTERS

1 Toilet seat
2 Toilet seat
3 Toilet lid
4 Hinge
5 First bearing tab
6 Second bearing tab
7 First hinge sleeve
8 Second hinge sleeve
9 Bracket element
10 Toilet bowl
11 First bearing pin
12 Second bearing pin
13 First hinge pin
14 Second hinge pin
15 Third hinge pin
16 Stop surface
17 Indentation
18 First omission
19 Second recess
20 Opening
21 Toilet
22 Radial area
23 Clamp area
24 Opening section
25 Outer contour
26 Recess longitudinal extension
A Changeable stop
D Axis of rotation of the hinge
E Direction of extension
EE Extension plane
L Longitudinal extension direction
R1 First direction
R2 Second direction
S1 First step
S2 Second step
W Angle

What is claimed as being new and desired to be protected by Letters Patent of the United States is as follows:

1. A toilet seat comprising:

hinge sleeves, the toilet seat being configured to be pushed or pushed open from a same side with the hinge sleeves on a hinge, the toilet seat in a first position is configured to be pushed onto the hinge that is coaxially with the toilet seat and rotatable to a rotation axis of the hinge; and a clamping element featuring two bearing tabs protruding therefrom, the two bearing tabs being configured to secure the toilet seat against axial displacement;

wherein at least one of the two bearing tabs of the clamping element includes a changeable stop by rotary movement of the clamping element around the rotation axis, wherein the hinge comprises:

a first bearing pin coaxial along the rotation axis of the hinge:

a second bearing pin that is spaced from the first bearing pin:

a first hinge pin protruding from the first bearing pin in a first direction along the rotation axis of the hinge; and a second hinge pin protruding from the second bearing pin in the first direction along the rotation axis of the hinge;

wherein the hinge sleeves comprises a first hinge sleeve and a second hinge sleeve, the first hinge sleeve is slidable or pushed on the first hinge pin, the second hinge sleeve is slidable or pushed on the second hinge pin:

wherein the changeable stop is on the first bearing pin when the clamping element is on a hinge arranged position on the hinge.

2. The toilet seat according to claim 1, wherein the first bearing pin includes a third hinge pin protruding therefrom in a second direction along the rotation axis of the hinge that is opposite to the first direction along.

3. The toilet seat according to claim 2, wherein the second hinge pin protrudes in the first direction beyond the second hinge sleeve when a position of the toilet seat is pushed onto the hinge.

4. The toilet seat according to any one of claim 3, wherein the clamping element is associated with a toilet lid rotatable around the rotation axis of the hinge.

5. The toilet seat according to claim 4, wherein the changeable stop is formed in at least one of the two bearing tabs protruding from the toilet lid.

6. The toilet seat according to claim 5, wherein the two bearing tabs of the toilet lid comprises a first bearing tab and a second bearing tab, wherein the changeable stop is formed on the first bearing tab.

7. The toilet seat according to claim 6, wherein the first bearing tab has a stop surface facing the second bearing tab, wherein in the stop surface includes an indentation defined therein, wherein the changeable stop includes the stop surface and the indentation.

8. The toilet seat according to claim 7, wherein the first bearing tab protrudes from the toilet lid in an extension direction substantially perpendicular to an extension plane of the toilet lid that protrudes from the toilet lid, wherein the indentation has a longitudinal length in a longitudinal extension direction, where imaginary lines along the extension direction and the longitudinal extension direction include an angle.

9. The toilet seat according to claim 8, wherein the indentation has a configuration corresponding to an external form of the first bearing pin.

10. The toilet seat according to claim 9, wherein the indentation includes a first recess.

11. The toilet seat according to claim 10, wherein the second bearing tab includes a clamping surface facing the first bearing tab, and a second recess extending in a recess longitudinal extension, wherein the clamping surface starting from the second recess has a radial opening, wherein the radial opening extends over an opening portion of an outer contour of the second bearing tab, wherein the radial opening starting from the second recess has a radial surface running substantially transversely to the recess longitudinal extension.

12. The toilet seat according to claim 11, wherein in the hinge arranged position of the toilet lid, the third hinge pin protrudes into the first recess of the first bearing tab, wherein the changeable stop is attached to the first bearing pin, wherein depending on a rotation position of the toilet lid about the rotation axis, the stop surface or the indentation on the first bearing pin is present, wherein the second hinge pin protrudes beyond the second hinge sleeve and into the second recess.

13. The toilet seat according to claim 12, wherein in a rotating position of the toilet lid, the stop surface is on the first bearing pin, one end of the second hinge pin in a direction of the recess longitudinal extension and protrudes beyond the radial surface into the second recess, wherein at the rotation position of the toilet lid, in which the indentation rests on the first bearing pin, an end of the second hinge pin in the direction of the recess longitudinal extension is located in front of the radial surface.

14. A toilet with a toilet bowl and including the toilet seat according to claim 1, wherein the hinge is arranged on the toilet bowl.

* * * * *